United States Patent [19]

Whitlam et al.

[11] Patent Number: 4,497,389

[45] Date of Patent: Feb. 5, 1985

[54] METHOD OF ERECTING DROP SCAFFOLDING, A DROP SCAFFOLDING STRUCTURE, AND A SCAFFOLD COUPLING THEREFOR

[75] Inventors: Joseph E. Whitlam, Barnsley; Alwyn H. Richards, Pontefract; Brian Akers, Sheffield, all of England

[73] Assignee: Whitlam Holdings Limited of Low Valley Industrial Estate, Barnsley, England

[21] Appl. No.: 320,888

[22] Filed: Nov. 13, 1981

[30] Foreign Application Priority Data

Nov. 19, 1980 [GB] United Kingdom ..... 8037144

[51] Int. Cl.[3] ..... E04G 3/10

[52] U.S. Cl. ..... 182/150; 182/178; 182/179; 403/395

[58] Field of Search ..... 182/150, 179, 178; 403/395, 390, 398, 399, 400; 52/637, 638

[56] References Cited

U.S. PATENT DOCUMENTS

| | | | |
|---|---|---|---|
| 1,434,352 | 10/1922 | Jester | 403/395 |
| 3,735,951 | 5/1973 | Reed | 182/150 |
| 3,938,290 | 2/1976 | Wyatt | 182/178 |
| 4,200,955 | 5/1980 | Kitchen | 182/150 |

FOREIGN PATENT DOCUMENTS

| | | | |
|---|---|---|---|
| 147113 | 6/1952 | Australia | 403/399 |
| 237078 | 1/1962 | Australia | 403/395 |
| 274653 | 5/1964 | Australia | 182/178 |
| 736097 | 7/1969 | Belgium . | |
| 467127 | 8/1950 | Canada | 403/395 |
| 562200 | 8/1958 | Canada | 182/178 |
| 198447 | 3/1906 | Fed. Rep. of Germany . | |
| 645766 | 5/1937 | Fed. Rep. of Germany . | |
| 2535205 | 2/1977 | Fed. Rep. of Germany . | |
| 2376709 | 8/1978 | France . | |
| 279077 | 2/1952 | Switzerland | 403/399 |
| 417032 | 1/1967 | Switzerland . | |
| 350296 | 10/1969 | Switzerland . | |
| 602208 | 5/1948 | United Kingdom . | |
| 647356 | 12/1950 | United Kingdom | 182/178 |
| 680354 | 10/1952 | United Kingdom . | |
| 688031 | 2/1953 | United Kingdom . | |
| 811425 | 4/1959 | United Kingdom . | |
| 934044 | 8/1963 | United Kingdom | 182/150 |
| 1250607 | 10/1971 | United Kingdom . | |
| 1544297 | 4/1979 | United Kingdom . | |

*Primary Examiner*—Reinaldo P. Machado
*Assistant Examiner*—Alvin Chin-Shue
*Attorney, Agent, or Firm*—Bert J. Lewen

[57] ABSTRACT

Drop scaffolding is formed by assemblies of drop tubes 12 and scaffold tubes 15 extending transversely between the drop tubes. Each drop tube has a top coupling secured to an upper part thereof and a bottom coupling secured to a lower part thereof, the two couplings being similar and having cradles with openings directed respectively generally downwardly and generally upwardly. Each coupling comprises an elongate body having a hollow section with a longitudinal axis extending the length of the body, in which section a drop tube is secured. A hook-like cradle 14*b*, 14*c*, 14*d* projects from the body away from the hollow section with an opening x between retaining walls 14*c*, 14*d*, each making an acute angle with the longitudinal axis of the section in the quadrant that includes the first end of the body. The cradle can receive a second scaffolding tube and releasable locking means 16 is movable between an open position allowing insertion of the second scaffolding tube into the cradle and a locking position wherein the second scaffolding tube is locked in the cradle.

The drop scaffolding is erected by forming a trapeze-like structure of two parallel drop tubes and a lower scaffold tube releasably secured in cradles of two bottom couplings. The structure is suspended from a top transverse tube by hooking top couplings secured to the drop tubes over the top transverse tube and thereafter releasably securing the couplings to the top transverse tube.

13 Claims, 6 Drawing Figures

METHOD OF ERECTING DROP SCAFFOLDING, A DROP SCAFFOLDING STRUCTURE, AND A SCAFFOLD COUPLING THEREFOR

This invention relates to a method of erecting drop scaffolding, to a drop scaffolding structure and to a scaffold coupling usable in the erection of drop scaffolding.

There are many environments where a scaffold needs to be erected below a surface and where there is no practical method of supporting that scaffold from below. It is therefore necessary to support the scaffold from above and this is effected by securing drop tubes to the underside of the surface, by climbing down the drop tubes and using conventional bolted scaffold clamps to secure horizontal ledger and transom tubes to the end of the drop tubes. The dangers of this practice are evident, particularly in hostile environments such as offshore oil rigs, and it is furthermore a time-consuming process. The present invention has for its objective the provision of drop scaffolding that can be erected more safely and rapidly than in the past.

According to the invention a method of erecting drop scaffolding comprises forming a trapeze-like structure of two parallel drop tubes and a scaffold tube extending transversely between the drop tubes, each drop tube having a top coupling secured to an upper part thereof against axial movement relative thereto, and a bottom coupling secured to a lower part thereof against axial movement relative thereto, each top coupling having a cradle with an opening directed generally downwardly and each bottom coupling having a cradle with an opening directed generally upwardly, the scaffold tube being releasably secured in the cradles of the two bottom couplings, hooking the trapeze-like structure to a horizontal support tube extending transversely of the drop tubes by engaging the cradles of the top couplings over the horizontal support tube, allowing the trapeze-like structure to hang vertically from the horizontal support tube and releasably securing the top couplings to the horizontal support tube.

From another aspect the invention provides a drop scaffolding structure comprising a pair of vertically extending drop tubes each having a top coupling secured to an upper part of the drop tube against axial movement relative to the drop tube, and a bottom coupling secured to a lower part of the drop tube against axial movement relative to the drop tube, each top coupling having a cradle with an opening directed generally downwardly, each bottom coupling having a cradle with an opening extending generally upwardly; an upper scaffold tube extending horizontally between the two drop tubes and releasably secured in the cradles of the two top couplings to suspend the drop tubes from the upper tube; and a lower scaffold tube extending horizontally between the two drop tubes and releasably secured in the cradles of the two bottom couplings to be supported thereby.

The top and bottom couplings may each be releasably secured to the respective drop tube, or any coupling may be permanently secured, e.g. by welding, to the respective drop tube.

The couplings that may be used can take many different forms, but further according to the invention such a coupling comprises an elongate body having a hollow section with a longitudinal axis extending the length of the body, within which section a drop tube of the scaffolding structure may be secured with its longitudinal axis substantially coincident with the longitudinal axis of the section; a hook-like cradle projecting from the body away from the hollow section with an opening directed generally towards a first end of the body, the cradle having a base and retaining walls extending from the base to the opening, the retaining walls each making an acute angle with the longitudinal axis of the section in the quadrant that includes the first end of the body, and the end-to-end axis of the cradle that is parallel to the base and retaining walls being perpendicular to the longitudinal axis of the hollow section, within which cradle a second scaffolding tube perpendicular to the drop tube may be received; and releasable locking means movable between an open position allowing insertion of a second scaffolding tube into the cradle and a locking position wherein the second scaffolding is locked in the cradle.

A coupling of this nature facilitates rapid engagement of couplings and tubes, even in difficult situations, and rapid and secure connection between couplings and tubes.

Preferably the acute angle between either of the retaining walls and the longitudinal axis is no more than 60°, and is desirably approximately 45°, desirably also the two walls are parallel. Use of such angles combines easy access to the cradle with the necessary degree of safety when in use the cradles are used in the manner of hooks to suspend and support scaffold tubes.

Preferably the releasable locking means when in its open position lies clear of the cradle opening and when in its closed position restricts the cradle opening to lock the second scaffolding tube therein.

Conveniently the locking means is a locking element positioned between the first end of the body and the base of the cradle and slidably mounted on the body for movement in a direction that is perpendicular both to the longitudinal axis of the hollow section and to the end-to-end axis of the cradle.

In one convenient form the locking member comprises a pair of parallel side plates spaced apart in the direction of the end-to-end axis of the cradle, the side plates extending through slots in front and rear walls of the body and lying one to each side of the hollow section at a spacing such that a drop tube may pass between them, the side plates being joined together outside the body by a cross-member at the front thereof and by a striker plate at the rear thereof. The striker plate may be struck to move the locking element forwardly from the open position to the locking position.

Clearly other types of locking members may be used, and these may be mounted either slidably or pivotally on the body.

There are a number of different ways in which the coupling and the drop tube may be secured together. In one form of the invention the coupling may be welded at each end thereof to the drop tube so as to be fixed in a permanent location thereon. A second form relies on the use of pins projecting from the body to engage in holes formed in the drop tube, desirably in combination with a locking member which is movable on the body to engage the drop tube. By a proper arrangement of pins and locking member a secure yet adjustable connection can be achieved. Other forms may rely on bolts or on the combination of lugs with various types of hooks, brackets or other fittings.

In order that the invention may be better understood a specific embodiment of a coupling in accordance therewith will now be described in more detail, by way of example only, with reference to the accompanying drawings in which.

Figure 1:
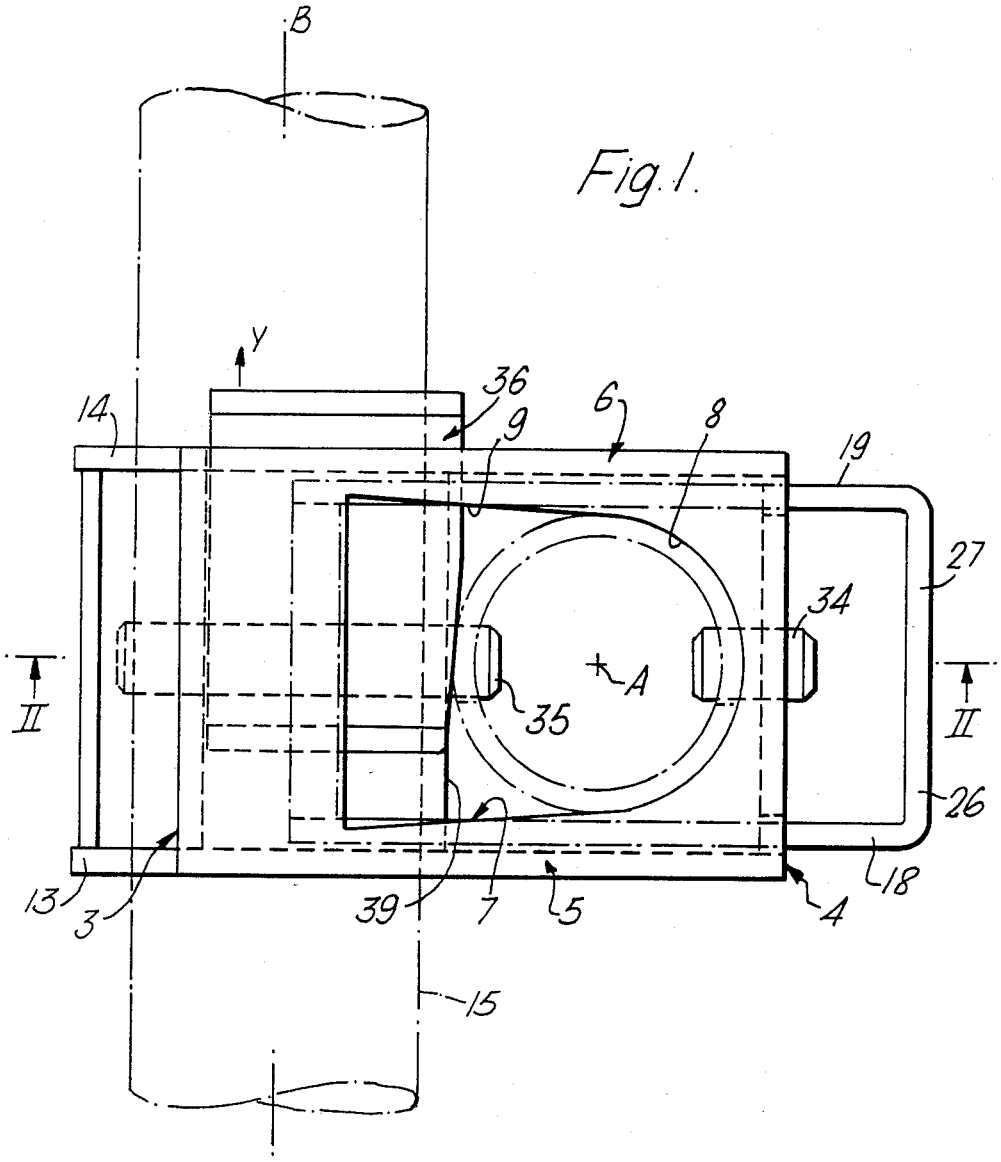
FIG. 1 is a plan view of a coupling according to the invention.

Referring to FIGS. 1 to 4 these show a coupling comprising a body that includes first and second end walls 1,2, a front wall 3, a rear wall 4 and side walls 5 and 6. The first end wall 1 has an opening 7 therein, the opening having, in upper plan view, a rearward part-circular section 8 and a forward section 9 that flares outwardly in the forward direction. The second end wall 2 terminates rearwardly in a part-circular section 10, the centres of the circles from which the sections 8 and 10 are drawn lying on a common axis A—A passing through the hollow section within the body and which is considered as the longitudinal axis of the coupling. Each of the sections 8 and 10 subtends an angle of approximately 180° to this axis. A further body part projects forwardly towards the axis from the rear wall 4 and presents a part-circular section 11 that is longitudinally aligned with and spaced from the section 8. The three part-circular sections 8, 10 and 11 each subtend an angle not exceeding 180° to the axis A—A and have a diameter that matches the standard outside diameter of a scaffold tube. The sections thus act as guides for locating a drop tube, shown in phantom outline as 12 in position in the coupling with the axis of the drop tube substantially coincident with the longitudinal axis A—A of the coupling. In this position the drop tube lies between the side walls 5 and 6 with clearance between the tube and the respective side walls for reasons which will become apparent. The tube also lies adjacent to but spaced from the rear wall 4 and in contact with a lower part 3*a* of the front wall 3, the upper part 3*b* of which is inclined away from the axis A—A towards the end wall 1.

The two side walls 5 and 6 are each formed with a hook section, 13, 14 respectively which projects from the front wall of the body away from the longitudinal axis A—A. The hook sections are joined together by an extension 3*c* of the front wall 3, extending firstly at approximately 90° away from the axis A—A and then inclined at an angle to suit the hook sections. The extension acts as a spacer and stiffener for the hook sections. The two hooks together form a hook-like cradle having a semi-circular base 14*b* and parallel retaining walls 14*c*, 14*d* extending from the base to an opening that extends diagonally outwardly of the body and towards the first end thereof. The retaining walls each make an acute angle $\alpha$ with the longitudinal axis A—A in the quadrant that includes the first end wall 1 of the body, the angle $\alpha$ in the embodiment shown being 45° and in any case being preferably not more than 60°. The cradle has an end-to-end axis B—B that is perpendicular to the longitudinal axis A—A.

The cradle opening has a width X which is slightly greater than the outside diameter of a scaffold tube and which leads into the semi-circular base of the cradle which has a diameter determined by the part-circular sections of the two hooks and which is also slightly greater than the external diameter of a scaffold tube. Accordingly, a scaffold tube as shown in phantom outline at 15 can be received in the cradle to extend perpendicular to the drop tube 12 and with its axis substantially coincident with the axis B—B of the cradle.

Once in position within the cradle a tube such as 15 may be locked to prevent its release from the cradle by a locking element shown generally as 16 slidably mounted on the body for movement in the direction that is mutually perpendicular to the axes A—A and B—B. The locking element has side plates 18 and 19 which pass through respective slots 20 and 21 in the rear wall 4 of the body and through respective slots 22 and 23 in the front wall 3 of the body. Within the body the side plates extend to opposite sides of the path of the drop tube 12 so that each side plate lies in a respective clearance between the drop tube and the adjacent side walls 5 or 6 of the body. The lower leading edges of the side plates 18 and 19 are tapered as at 24 and the plates are joined by a cross-member 25 lying outside the body 1. The rear ends of the side plates 18 and 19 are bent through 90° to form sections 26, 27 lying outside the rear wall of the body and terminating closely adjacent one to the other or joined one to the other. The sections 26 and 27 form a striker plate which may be struck to move the locking element from the rearward position shown in solid lines in FIG. 2 wherein it lies clear of the cradle opening to the forward position shown in phantom outline in FIG. 2 wherein the leading sections of the side walls 18 and 19 restrict the cradle opening to lock the scaffold tube 15 in position in the cradle. The tapered formation of the lower leading edges of the side plates of the locking element facilitates this movement of the element. The taper lock is obtained by the upper edges of the side plates 18 and 19 bearing against the lower face of a further extension 3*d* of the front wall, and the tapered formation of the lower leading edges of those plates bearing directly on the tube 15.

Figure 2:
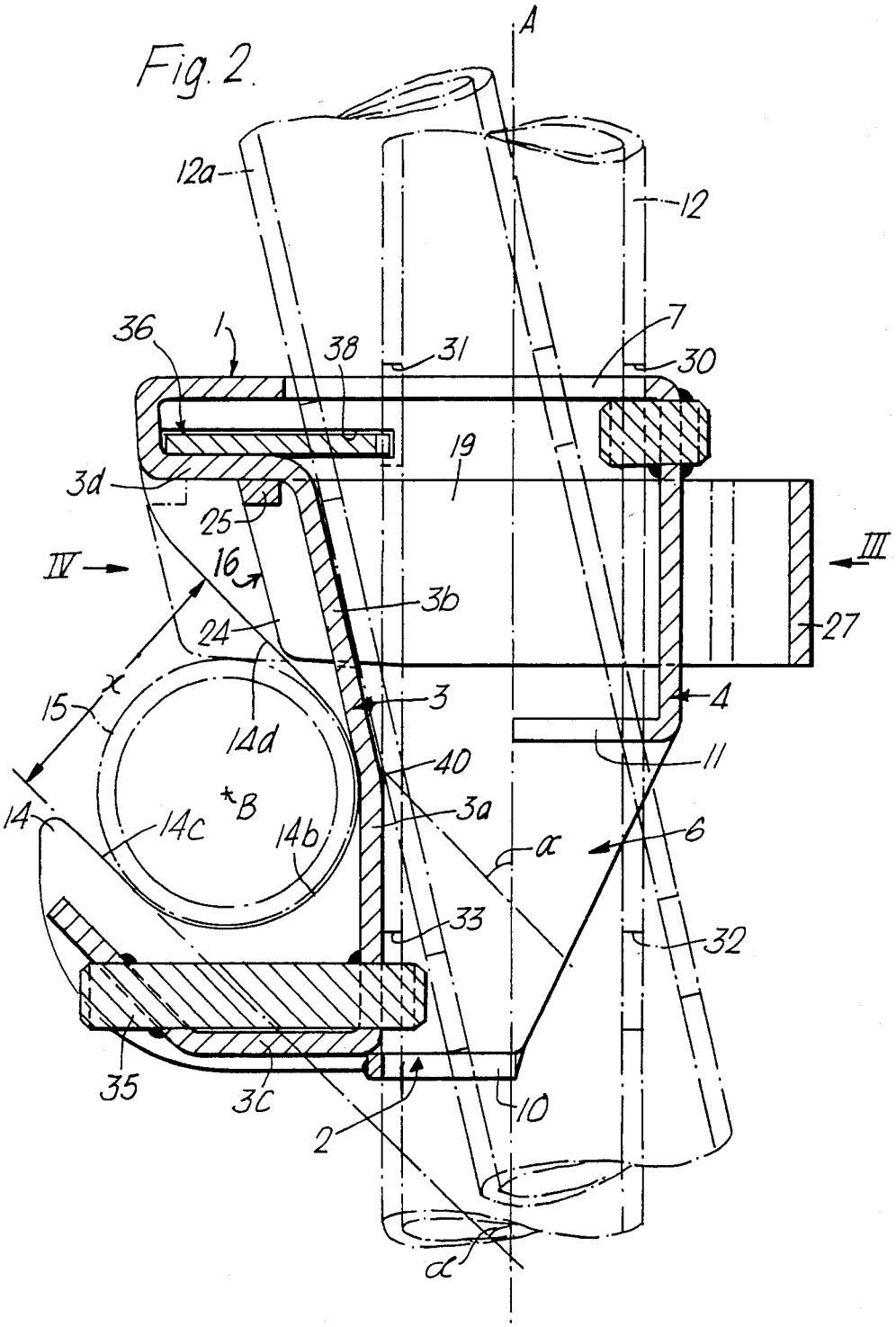
FIG. 2 is a cross-section on the line II—II of FIG. 1.
Figure 3:
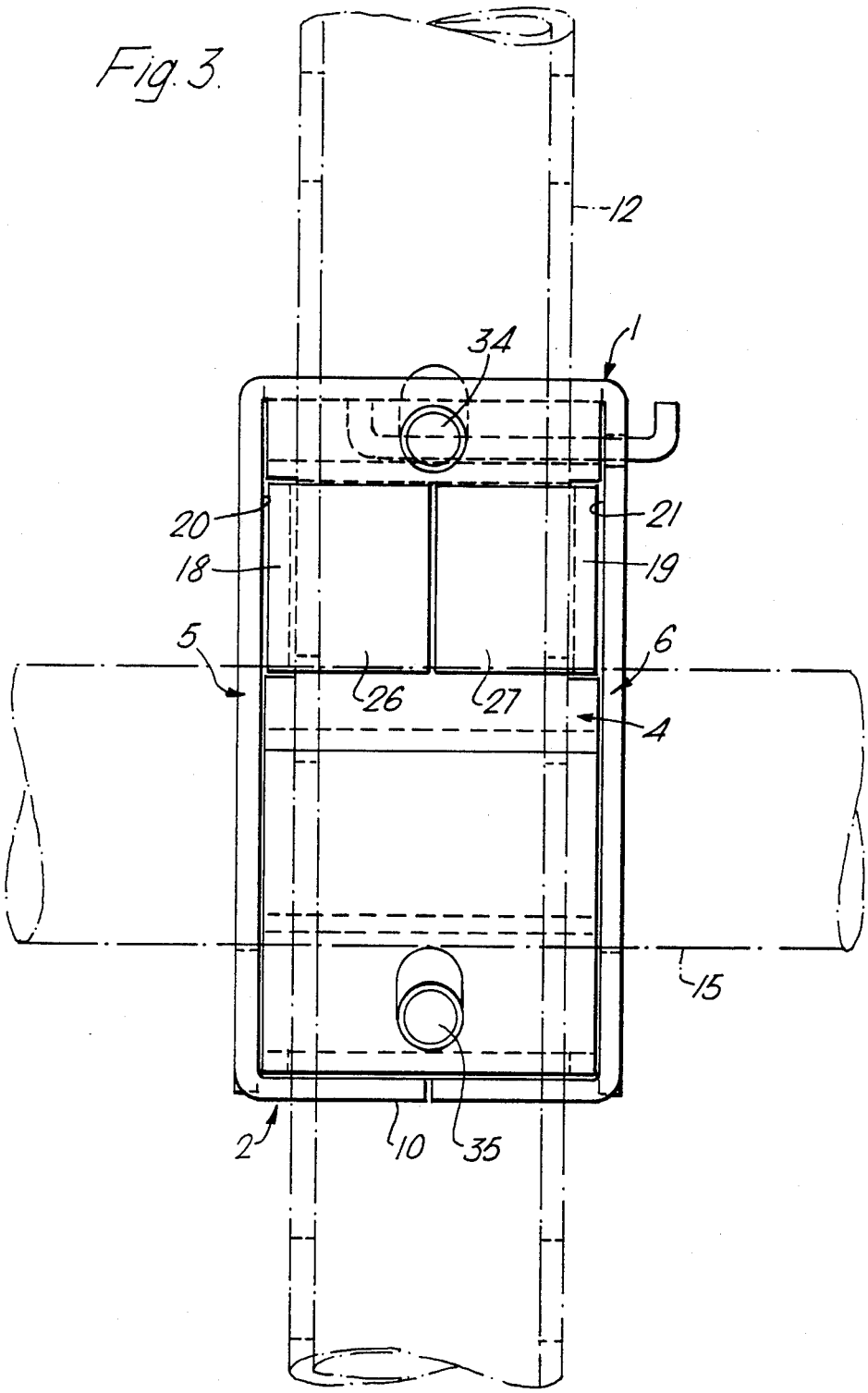
FIG. 3 is an elevation in the direction of the arrow III of FIG. 2.
Figure 4:
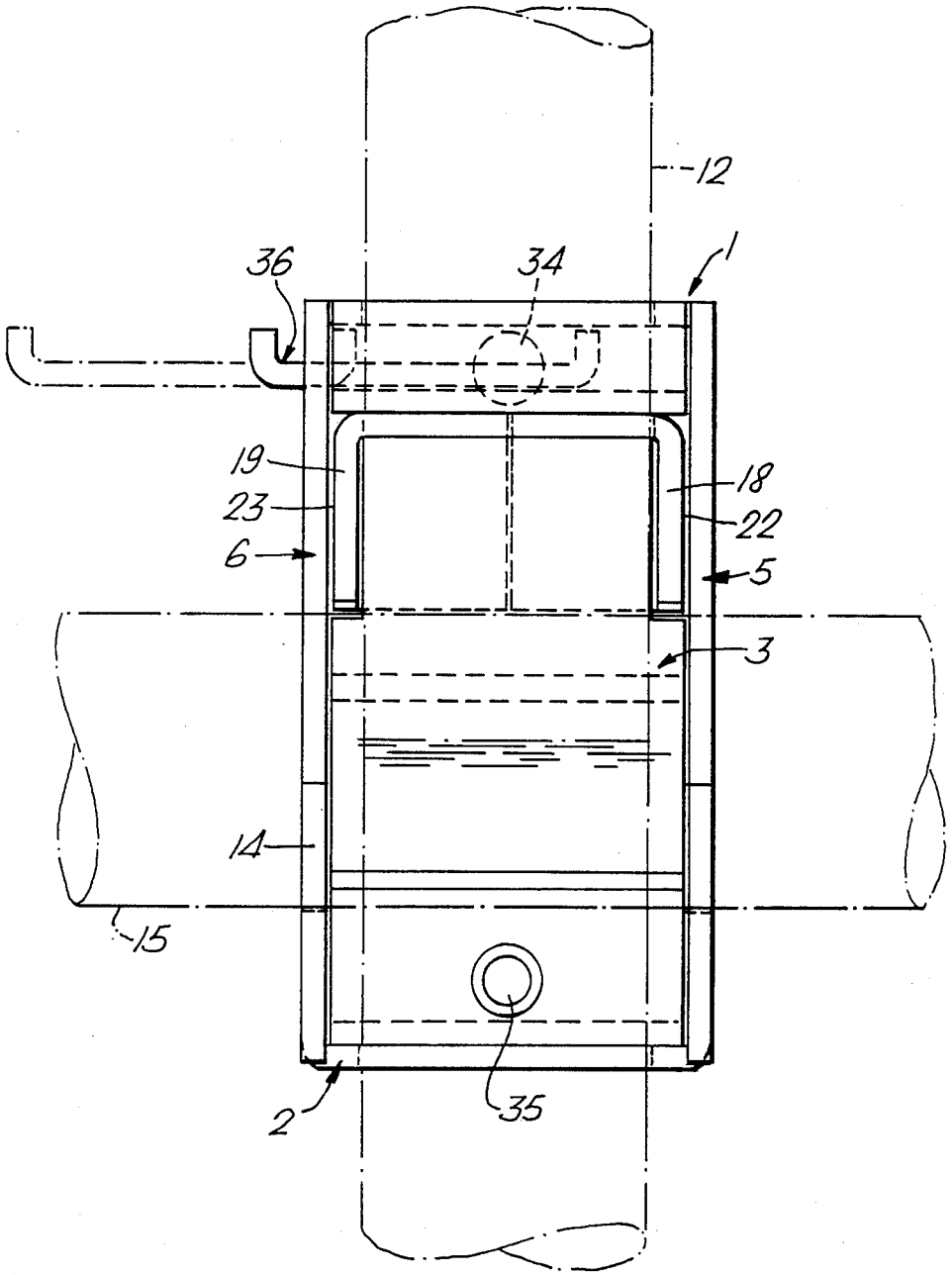
FIG. 4 is an elevation in the direction of the arrow IV of FIG. 2.

As well as locking the tube 15 to the coupling it is of course necessary to lock the coupling to the drop tube 12. In the embodiment shown in the drawings the position of the coupling on the drop tube is adjustable, and for this purpose the drop tube is formed with two opposed sets of longitudinally spaced holes, the holes forming diametrically opposite pairs such as 30, 31 and 32, 33. Alternatively, the holes in one set may be staggered longitudinally relative to those in the other set. A first pin 34 of diameter less than the diameter of the holes in the drop tube extends through the thickness of, and is welded to, the rear wall 4 of the body. A second pin 35 of substantially the same diameter as pin 34 extends over the extension 3*c* of the front wall, through the section 3*a* of the front wall 3 and is welded to the extension and to the section. The pins 34 and 35 are displaced longitudinally one from the other by a distance equal to the centre to centre distance between adjacent pairs of holes in the drop tube, and have their longitudinal axes lying in a common plane with the axis A—A. The pins extend from opposite directions towards the axis A—A and they are therefore capable of engaging holes in opposite sides of the drop tube 12, e.g. holes 30 and 33 as shown in FIG. 2. To effect such engagement the coupling is fitted onto the drop tube with the longitudinal axis of the drop tube making an angle with the longitudinal axis A—A of the coupling, for example with the drop tube at an angle as indicated by the phantom outline 12*a* in FIG. 2, which may match the angle of the part 3*b* of the front wall 3. The drop tube and the coupling are then relatively tilted so that the pins 34 and 35 engage in respective holes in the drop tube, the angular entry of the drop tube into the coupling and the pivotal movement being allowed by the elongated space in the first end wall 1 of the coupling and the fact that the rear wall 4 of the coupling is cut away at the level of the part defining the section 11 so leaving free space between the downward extensions of the side walls 5, 6 from that part.

In order firmly to secure the coupling to the drop tube a wedge plate 36 is provided which rests partially on the section 3*d* of the front wall 3 and which extends through a slot 38 in the side wall 6. The wedge plate 36 has a tapered edge 39 facing towards the axis A—A. The wedge plate may be withdrawn in the direction of the arrow Y from the locking position shown in FIG. 1 and in that position it does not restrict movement of the drop tube within the body. However, when the drop tube has been inserted and the pins 34, 35 have been properly engaged with the holes in that tube the wedge plate may be moved to the position shown in FIG. 1 wherein it contacts the drop tube on the side diametrically opposite from the region of engagement of the pin 34. Thus, pivoting of the drop tube about the fulcrum by the region 40 of the front wall is positively prevented and the coupling is locked firmly to the tube. It should in any case be noted that when the coupling is in use under load the natural tendency is for the coupling to pivot in a sense that will tend to force the pins 34 and 35 into, rather than out of the holes 30 and 33.

The simplicity with which the coupling shown in the drawings can be used will now be appreciated. Both the drop tube and the second tube may be fitted readily into their respective locations within the coupling and are then locked in place by a simple sliding action of the respective wedge. The need for bolts in this coupling is eliminated. The coupling has inbuilt fail-safe qualities in that even if both locking wedges should fail under fully loaded conditions the coupling will not slide off the drop tube nor will the coupling and the cross tube become disengaged. It will be appreciated that the coupling may be fitted to the drop tube either with the first end wall uppermost as shown in the drawings, or with the second end wall uppermost. In the former position the coupling is used to support a transom tube from the drop tube, desirably at the lower end of the drop tube. In the latter position an inverted coupling at the upper end of the drop tube may be used to support the drop tube from a horizontal scaffold tube near the upper end thereof. This arrangement makes possible the erection of drop scaffolding in a much safer way than has heretofore been possible, as will become apparent from the following description. Before giving that description, however, it should be stated that in a modified form of the coupling it may be designed so that it can be welded at each end wall thereof to a tube that is destined to be a drop tube. The coupling shown in the drawings could of course, after the coupling has been fitted to the tube so that the pins 34 and 35 engage holes in the tube, be secured by welding between the sections 8, 10 and 11 and the tube. However, with a welded connection between the coupling and the tube the pins are not necessary, neither is it necessary to have the elongated opening 7 in the first end wall of the coupling or the cut-away region below the part defining the section 11 and extending inwardly from the rear wall. The coupling may thus be formed with a continuous rear wall and with first and second end walls that are continuous except for aligned circular openings having centres lying on the axis A—A of the couplings and having diameters such that they will be a close fit around a scaffold tube. Such a coupling may thus be slid onto a tube with the tube passing through the aligned openings in the end walls, and a connection may then be effected by welding between the tube and the end walls around the opening in those walls. Where adjustability is not required drop tubes may be pre-fitted with two such couplings, one adjacent to each end of the drop tube, the couplings being inverted one with respect to the other and having their cradles each opening generally towards the centre of the tube.

Figure 5:
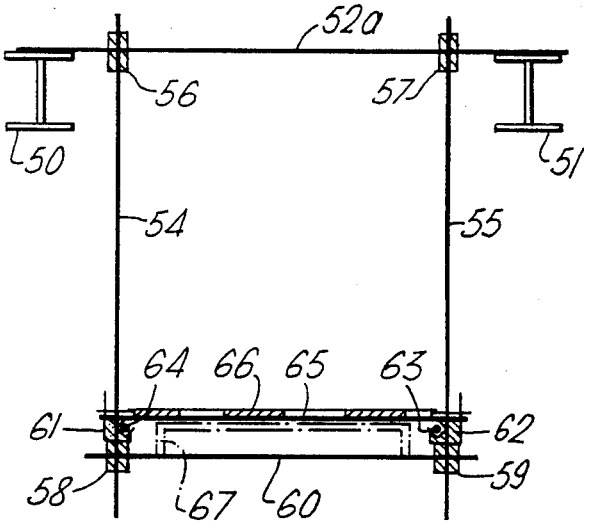
FIGS. 5 and 6 are respectively end and side schematic elevations of a drop scaffolding according to the invention.
Figure 6:
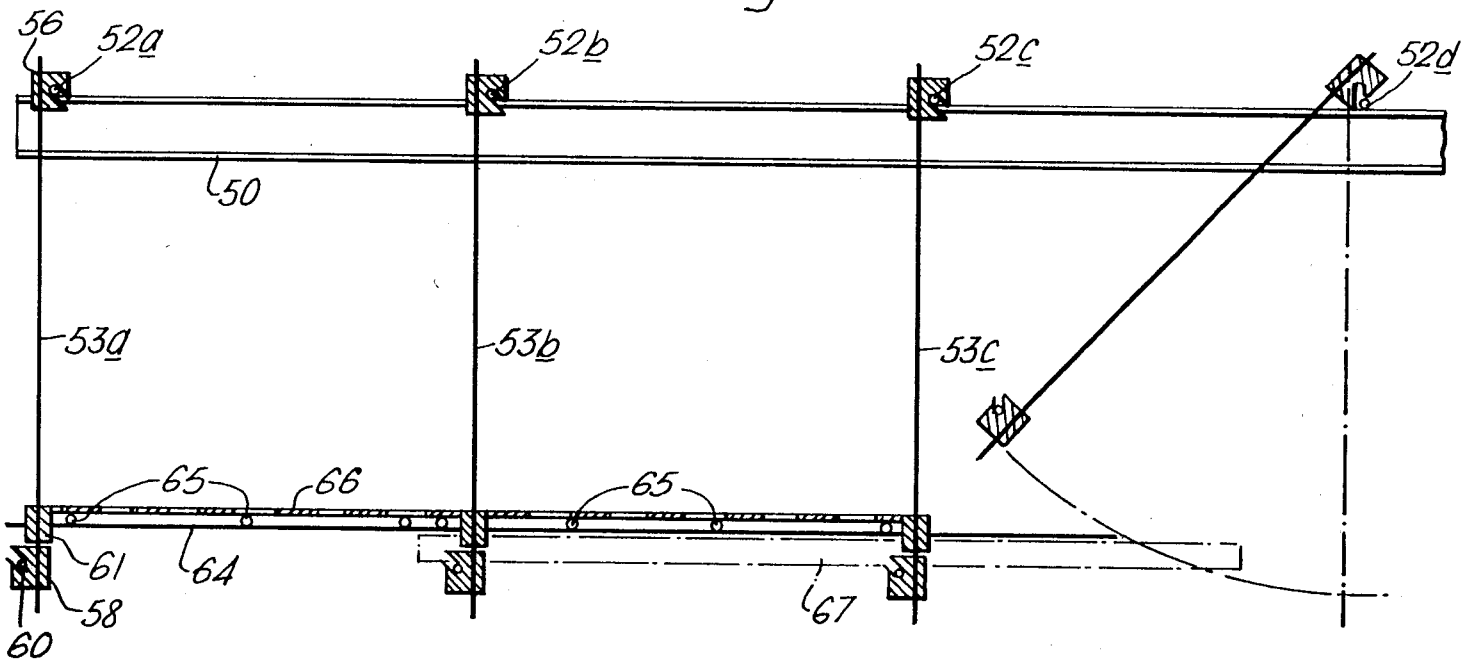

FIGS. 5 and 6 illustrate schematically one way in which the couplings described may be used in erecting a drop scaffold below two beams 50 and 51, the beams being spanned by a series of scaffold tubes 52*a*, 52*b*, 52*c* etc. secured equal distances apart to the upper side of the beams. Alternatively these cross tubes could be tubes of measured length secured to the upper faces of the lower flanges of the beams and extending between the walls of those beams. A first trapeze-like structure 53*a* is erected on a platform above the beam. The structure 53*a* comprises two drop tubes 54, 55 each having a coupling 56, 57 respectively welded or otherwise secured adjacent to its upper end and presenting a downwardly opening cradle. Two further couplings 58, 59 inverted with respect to the couplings 56, 57 are welded or otherwise secured to the drop tubes adjacent to their lower ends. A cross tube 60 is inserted into the upwardly opening cradles of couplings 58 and 59 and is secured in position in those cradles by appropriate movement of the locking element 16 of each coupling. This structure is lowered from above the beams until the couplings 56 and 57 engage over the first cross tube 52*a*. When such engagement has been effected the locking elements 16 of those couplings are moved to the locking position so that a secure connection is established between the cross tube 52*a* and the drop tubes 54, 55. Similar trapeze-like structures 53*b*, 53*c* etc. may then be located. If access can readily be gained from the top of the beams then each such structure may simply be dropped from above the beams and secured as already described. If, however, access from the top of the beams is not available then workmen may readily descend the drop tubes 54, 55 of the first structure 53*a* to find a secure foot-hold on the cross tube 60. From that position they may project forward either an already erected second trapeze-like structure, or individual drop tubes followed by the cross tube, and may hook the two couplings at the upper ends of the drop tubes of that structure over the appropriate cross tube, for example as indicated in connection with cross tube 52*d*. Having effected this hook engagement the structure may then merely be allowed to swing into position about those couplings after which it will stabilise to a position where the drop tubes hang vertically. As soon as two such trapeze-like structures are in position it will be apparent that boards can be positioned to span the cross tubes of the two adjacent structures thus giving an extremely safe working platform from which further structures may be advanced to extend the scaffold as required. The trapeze-like structures will, in the final erected scaffold, be linked by ledgers secured above and to the cross tubes by conventional fittings and guard rails secured to the drop tubes by conventional fittings. Transom tubes are secured above and to the ledgers at regulation spacings and boards are laid on the transoms. This linking proceeds bay by bay in conjunction with the formation and fixing of each trapeze-like structure. Alternatively, lightweight stagings may be used rather than scaffold boards, so removing the necessity for ledgers and transoms. In this case linking of the trapeze-like structures will be effected through the handrailing of the stagings.

FIGS. 5 and 6 show a different way in which the working platform may be constructed by using two further couplings 61 and 62, also welded or otherwise secured to the drop tubes immediately adjacent the couplings 58, 59 but rotated relatively to those couplings about the axis of the drop tubes through angles of 90°. The aligned couplings 61 or 62 of a plurality of trapeze-like structures may be used to support horizontally extending ledger tubes 63, 64. Transom tubes such as 65 may be secured to the ledger tubes 63 and 64 by conventional scaffold fixings and they may be used as supports for planks or decking 66. The advantage of this structure which spaces the transom tubes 65 significantly above the cross tubes 60 is that it enables an auxiliary platform 67 to be positioned between the cross tubes and transom tubes as shown in FIG. 6, and to be cantilevered out beyond the end of the last secure trapeze-like structure, for example beyond the structure 53*c* as shown in FIG. 6. This extension of the safe working surface further facilitates the erection and securing of the next trapeze-like structure.

The advantage of having immediate safe working platforms will readily be appreciated. The simplicity of erection will also be evident, particularly the advantage of being able to effect locking to the coupling by a simple sliding movement of an appropriate locking element the movement being effected, for example, by striking the element with a hammer. This contrasts well with the need in conventional systems to ensure that clamping bolts are properly tightened. Similarly, unlocking can be effected by a simple striking action, rather than removal of bolts. Systems using adjustable coupling members may be utilised to provide scaffolds having different headrooms. Drop tubes having coupling members welded thereto at fixed spacings may be used to construct scaffolds with fixed headroom. It will of course be understood that the two arrangements may be combined as required.

We claim:

1. A method of erecting drop scaffolding comprising; taking first and second drop tubes, each drop tube having a top coupling secured by first securing means to an upper part thereof against axial movement relative thereto, and a bottom coupling secured by the second securing means to a lower part thereof against axial movement relative thereto, each top coupling having a cradle with an opening directed generally downwardly and each bottom coupling having a cradle with an opening directed generally upwardly; hooking the top coupling of each drop tube to a horizontal support tube that is secured against vertical movement, the support tube extending transversely of the drop tubes, while the drop tubes are inclined at an acute angle to the vertical; swinging the trapeze-like structure formed by the drop tubes and a scaffold tube extending transversely between said drop tubes parallel to said horizontal support tube and releasably secured in the cradles of the two bottom couplings so that said drop tubes move from said inclined position to hang vertically from the horizontal support tube; and releasably securing the top couplings to the horizontal support tube.

2. A drop scaffolding structure comprising a pair of vertically extending drop tubes each having a top coupling secured by first securing means to an upper part of the drop tube against axial movement relative to the drop tube, and a bottom coupling secured by second securing means to a lower part of the drop tube against axial movement relative to the drop tube, each top coupling having a cradle with an opening directed generally downwardly, each bottom coupling having a cradle with an opening extending generally upwardly; and a lower scaffold tube extending horizontally between the two drop tubes and releasably secured in the cradles of the two bottom couplings to be supported thereby; whereby said structure may be hooked to an upper scaffold tube secured against vertical movement and extending horizontally between the two drop tubes parallel to the lower scaffold tube by releasably securing said upper scaffold tube in the cradles of the two top couplings to suspend the drop tubes from the upper tube.

3. A drop scaffolding structure according to claim 2 in which at least one of said securing means is releasable to allow adjustment of the respective coupling axially along the respective drop tube.

4. A coupling for use in the erection of a drop scaffolding structure, the coupling comprising an elongate body having a hollow section with a longitudinal axis extending the length of the body, within which section a drop tube of the scaffolding structure may be secured with its longitudinal axis substantially coincident with the longitudinal axis of the section; releasable securing means for securing said coupling in any position selected from a plurality of adjustment positions axially of said drop tube; a hook-like cradle integral with and projecting from the body away from the hollow section with an opening directed generally towards a first end of the body, the cradle having a base and retaining walls extending from the base to the opening, the retaining walls each making an acute angle with the longitudinal axis of the section in the quadrant that includes the first end of the body, and the cradle having an end-to-end axis that is parallel to the base and to the retaining walls and is perpendicular to the longitudinal axis of the hollow section, within which cradle a second scaffolding tube perpendicular to the drop tube may be received; and releasable locking means mounted on said first end of said body and movable perpendicular to said end-to-end axis along a straight line between an open position allowing insertion of a second scaffolding tube into the cradle and a locking position wherein said locking means may engage said second scaffolding tube to apply thereto a force which locks said second scaffolding tube against said retaining walls and said base.

5. A coupling according to claim 4 in which the acute angle between either of the retaining walls and the longitudinal axis is not more than 60°.

6. A coupling according to claim 5 in which the acute angle between either of the retaining walls and the longitudinal axis is approximately 45°.

7. A coupling according to claim 4 in which the retaining walls are parallel.

8. A coupling according to claim 4 in which the releasable locking means when in its open position lies clear of the cradle opening and when in its closed position restricts the cradle opening to lock the second scaffolding tube therein.

9. A coupling according to claim 8 in which the releasable locking means is a locking element positioned between the first end of the body and the base of the cradle and slidably mounted on the body for movement in a direction that is perpendicular to the longitudinal axis of the hollow section.

10. A coupling according to claim 9 in which the locking element comprises a pair of parallel side plates spaced apart in the direction of the end-to-end axis of the cradle and joined by at least one member extending parallel to that axis.

11. A coupling according to claim 10 in which the side plates extend through slots in front and rear walls of the body and lie one to each side of the hollow section at a spacing such that a drop tube may pass between them, the side plates being joined together outside the body by a cross-member at the front thereof and by a striker plate at the rear thereof.

12. A coupling according to claim 4 for use with a drop tube having two opposed sets of longitudinally spaced holes, in which the releasable securing means for securing the coupling to the drop tube comprise a first pin projecting into the hollow section from a rear wall of the body towards the longitudinal axis adjacent to the first end of the body, a second pin projecting into the hollow section from a front wall of the body towards the longitudinal axis adjacent to the second end of the body, the pins being engageable with respective longitudinally spaced holes of the two sets of holes, and a locking member located opposite to the first pin and movable to engage part of a drop tube lying adjacent to the front wall of the body.

13. A coupling according to claim 12 in which the locking member is a locking wedge slidably mounted on the body for movement in a direction parallel to the end-to-end axis of the cradle.

* * * * *